US007287292B2

(12) United States Patent
Kim

(10) Patent No.: US 7,287,292 B2
(45) Date of Patent: Oct. 30, 2007

(54) WASHING MACHINE CONTROL METHOD

(75) Inventor: Jong Ho Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/720,681

(22) Filed: Nov. 25, 2003

(65) Prior Publication Data

US 2004/0163183 A1 Aug. 26, 2004

(30) Foreign Application Priority Data

Nov. 26, 2002 (KR) ..... 10-2002-0073900

(51) Int. Cl.
*D06F 35/00* (2006.01)

(52) U.S. Cl. ..... 8/158; 68/12.04; 68/12.05; 8/159

(58) Field of Classification Search ..... 8/158, 8/159; 134/18; 68/12.04, 12.05
See application file for complete search history.

(56) References Cited

U.S. PATENT DOCUMENTS

| | | | | |
|---|---|---|---|---|
| 5,720,064 | A * | 2/1998 | Koo | 8/158 |
| 5,768,728 | A * | 6/1998 | Harwood et al. | 8/158 |
| 2004/0148709 | A1 * | 8/2004 | Kim et al. | 8/158 |
| 2005/0015891 | A1 * | 1/2005 | Koo et al. | 8/159 |

FOREIGN PATENT DOCUMENTS

KR 1999-27766 4/1999

* cited by examiner

*Primary Examiner*—Alexander Markoff
(74) *Attorney, Agent, or Firm*—McKenna Long & Aldridge LLP

(57) ABSTRACT

A washing machine control method prevents the setting of an incorrect water level, when laundry is added to the washing machine after manipulating a wash command key, by setting an accurate water level and wash pattern. The water level and wash pattern are repeatedly reset according to a differential present in consecutively sensed wet laundry amounts, if a substantial differential is detected between dry and wet laundry amounts. That is, if the difference between consecutively sensed wet laundry amounts is reduced to a predetermined value, within a predetermined number of repeated sensings, the washing step is controlled according to reset values for the water level and wash pattern. The method includes steps of determining a first water level by sensing a first laundry amount upon initiating a washing step; determining a first wash pattern by sensing a second wet laundry amount; comparing the sensed first and second laundry amounts to determine a first differential; and resetting the determined water level and wash pattern by sensing a third laundry amount, if the first differential is greater than a first predetermined value. The water level and wash pattern are reset by comparing consecutively sensed laundry amounts to determine a second differential; re-sensing the third laundry amount, if the second differential is greater than a second predetermined value; setting a second water level and a second wash pattern based on a current value of the re-sensed third laundry amount, if the second differential is not greater than the second predetermined value; and performing the washing step according to the second water level and the second wash pattern.

9 Claims, 3 Drawing Sheets

WASHING MACHINE CONTROL METHOD

This application claims the benefit of Korean Application No. 10-2002-0073900 filed on Nov. 26, 2002, which is hereby incorporated by reference.

BACKGROUND OF THE INVENTION

1. Field of the Invention

The present invention relates to a washing machine, and more particularly, to a method of sensing a laundry amount in a washing machine.

2. Discussion of the Related Art

Generally, a washing machine is an apparatus for washing laundry by performing washing, rinsing, and dewatering steps according to a predetermined algorithm, i.e., a selected wash course, whereby water is supplied to an appropriate water level, which is determined in part by sensing an amount of laundry placed in the washing machine before initiating a wash command and setting a water level accordingly. The laundry amount is sensed using a voltage sensing unit, which is configured with a motor and clutched pulley assembly for the drive of a pulsator within a tub and essentially consists of a microprocessor receiving a voltage signal generated by an opposing pair of rotating magnets and a fixed coil disposed with respect to the magnets. That is, upon input of a wash command, the pulsator is rotated for a predetermined time to generate movement in the laundry. Simultaneously, the rotating magnets of the voltage sensing unit generate a series of pulses by disrupting the flux field of the coil. Notably, the effected rotational speed of the pulsator varies according to the amount of laundry in the tub, to produce a varying number of pulses, i.e., a pulse count, for input to the microcomputer.

Referring to FIG. 1, a washing machine according to a related art is comprised of a key input unit 1 for inputting a user command; a voltage sensing unit 2 for monitoring a voltage and providing a voltage signal output in the form of a series of voltage pulses as described above; a controller 3, e.g., a microcomputer, for receiving the voltage signal and outputting a control signal to control the washing machine according to the received voltage signal; a load driver 4 for driving various loads (not shown) such as a motor, valves, and the like according to the control signal; and a display 5 for displaying an operational status of the washing machine. Typically, laundry is placed in the washing machine, the washing machine is turned on, and a wash command is input via the key input unit 1, whereupon the controller 3 outputs a wash command control signal to the load driver 4 to rotate the pulsator for a predetermined time.

As a result, a predetermined number of pulses is generated in proportion to the amount of laundry placed in the tub. The pulses are input to the controller 3, which counts the pulses to determine a pulse count falling into one of a plurality of ranges, i.e., 30~52, 53~77, 78~98, 99~119, and 120 or more, designated as high, medium, low, small, and minimum, respectively. Accordingly, a low pulse count, meaning a slow pulsator rotation due to a large amount of laundry (load), results in the setting of a high water level; and a high pulse count, meaning a fast pulsator rotation due to a small laundry load, results in the setting of a low water level. The controller 3 then determines the water level setting by comparing the sensed pulse count to an internally stored table, comprised of a plurality of predetermined water level values according to corresponding pulse counts as above, and outputs a control signal to the load driver 4 for performing a washing step in accordance with a washing machine control method such as that shown in FIG. 2.

Referring to FIG. 2, illustrating a washing machine control method according to a related art, a dry laundry amount in a tub is sensed (S1) to determine a corresponding water level (S2), and water is supplied to the tub (S3) until the water level is reached (S4). Thereafter, the laundry amount is sensed again, i.e., a wet laundry amount (S5), to determine a wash pattern (S6). Finally, washing is performed according to the wash pattern (S7).

In the above process, it is assumed that laundry is placed in the tub before initiating the dry laundry amount sensing step, e.g., by manipulation of a wash command key of the key input unit 1. If, however, manipulation of the wash command key occurs before the laundry is placed in the tub, an empty washing machine is activated, so that the laundry amount is sensed without any laundry load (an empty washing machine), which results in a maximum pulse count, i.e., greater than 120, and the corresponding minimum water level setting. At the same time, it should be appreciated that at least a portion of the laundry may be placed in the tub after the wash command key manipulation. In doing so, the wash step is performed based on an inaccurate sensing of the laundry amount, which degrades washing performance. That is, the water level according to the sensed laundry amount is already set when the wash pattern is determined.

SUMMARY OF THE INVENTION

Accordingly, the present invention is directed to a method of sensing a laundry amount in a washing machine that substantially obviates one or more of the problems due to limitations and disadvantages of the related art.

An object of the present invention, which has been devised to solve the foregoing problem, lies in providing a washing machine control method, which enables an accurate sensing of the laundry amount, before or after inputting a wash command key to initiate a washing step.

It is another object of the present invention to provide a washing machine control method which enables improved washing performance.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine control method comprising steps of determining a first water level by sensing a first laundry amount upon initiating a washing step; determining a first wash pattern by sensing a second wet laundry amount; comparing the sensed first and second laundry amounts to determine a first differential; and resetting the determined water level and wash pattern by sensing a third laundry amount, if the first differential is greater than a first predetermined value. The above resetting step comprising steps of comparing consecutively sensed laundry amounts to determine a second differential; re-sensing the third laundry amount, if the second differential is greater than a second predetermined value; setting a second water level and a second wash pattern based on a current value of the re-sensed third laundry amount, if the second differential is not greater than the second predetermined value; and performing the washing step according to the second water level and the second wash pattern.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
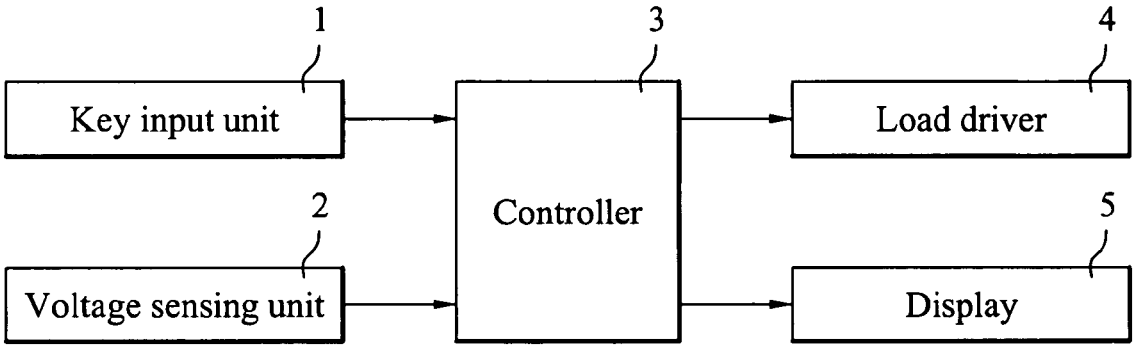
FIG. 1 Related Art
FIG. 1 is a block diagram of a general washing machine.
Figure 2:
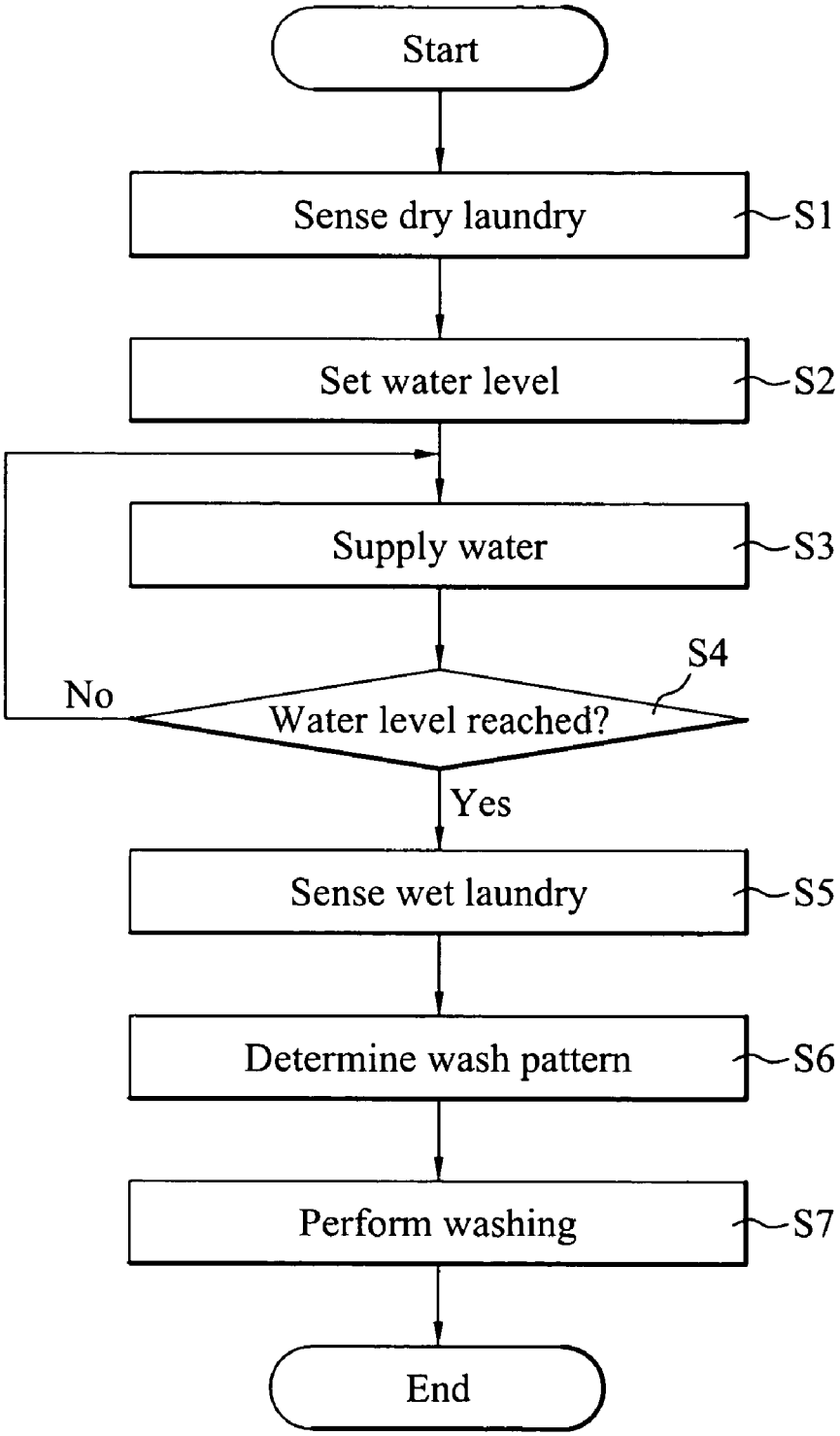
FIG. 2 Related Art
FIG. 2 is a flowchart of a washing machine control method according to a related art.
Figure 3:
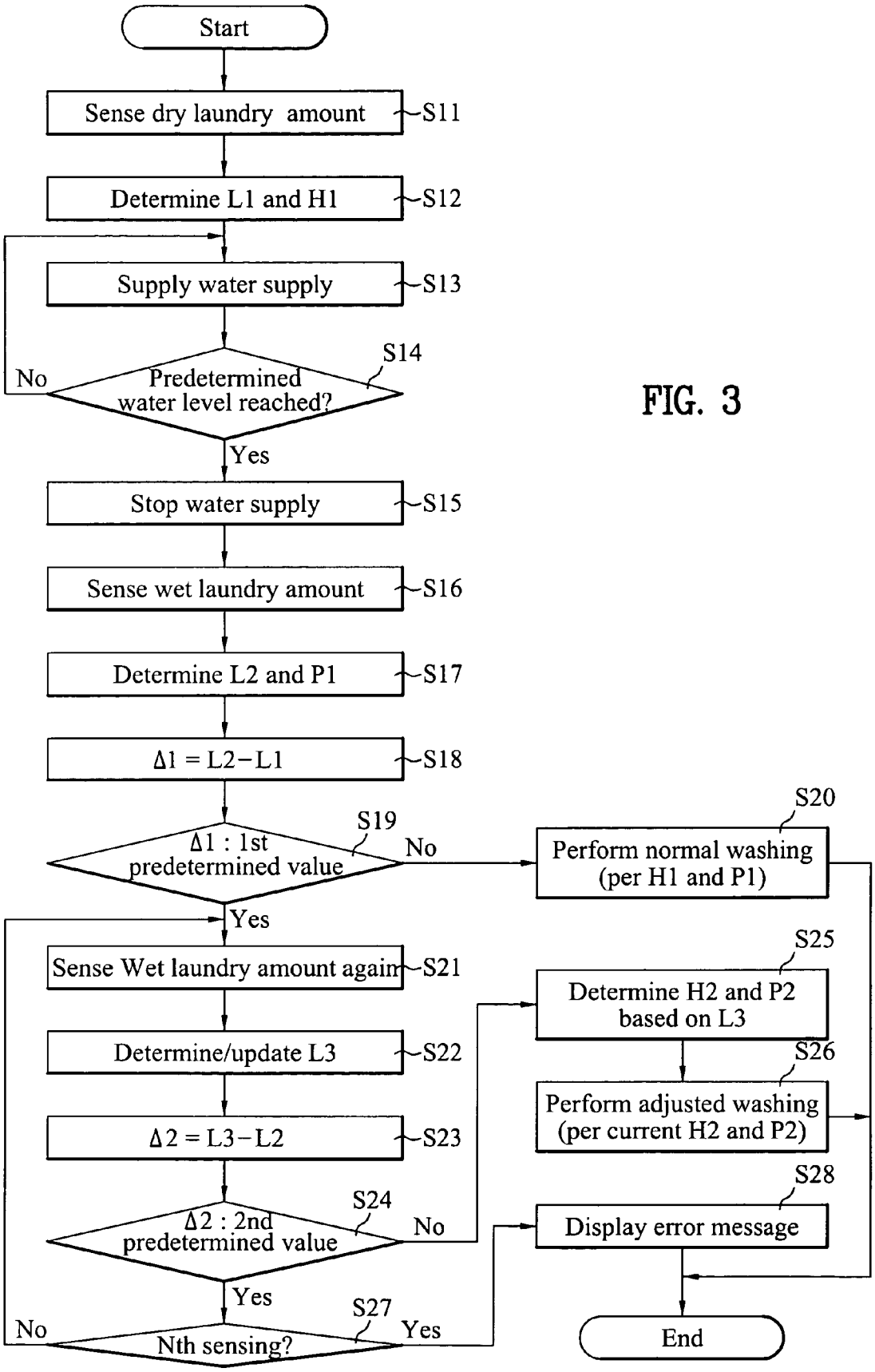
FIG. 3 is a flowchart of a washing machine control method according to the present invention.

Referring to FIG. 3, illustrating washing machine control method according to the present invention, once a wash command key is input, a dry laundry amount is sensed (S11) to determine (S12) a first laundry amount L1 and a first water level H1, and water is supplied to the tub until reaching the first water level H1 (S13). While the water supply step is being performed, it is determined whether a predetermined water level is reached (S14), whereupon the water supply step is stopped (S15) to sense a wet laundry amount (S16) to determine (S17) a second laundry amount L2 and a wash pattern P1.

A first laundry amount differential Δ1 is calculated (S18) by applying the values of L1 and L2 to the equation Δ1=L2−L1, and the value of Δ1 is compared (S19) to a first predetermined value. If the value of Δ1 is less than or equal to the predetermined value, it is determined that normal washing is to be performed (S20) based on an amount of laundry placed in the washing machine before input of a wash command key, that is, according to the first water level H1 and the washing pattern P1.

On the other hand, if the value of Δ1 is greater than the first predetermined value, the wet laundry amount is sensed again (S21) to determine (S22) the value of a third laundry amount L3 (S21). Then, a second laundry amount differential Δ2 is calculated (S23) by applying the values of L2 and L3 to the equation Δ2=L3−L2, and the value of Δ2 is compared (S24) to a second predetermined value. If the value of Δ2 is less than or equal to the second predetermined value, it is determined that the wash parameters, namely, the water level and wash pattern, are to be reset. Thus, a new water level H2 and a new wash pattern P2 are determined (S25) based on the current value of L3, so that an adjusted washing step can be performed (S26).

On the other hand, if the value of Δ2 is greater than the predetermined value, the wet laundry amount is sensed yet again. The sensing of the wet laundry amount may be repeated a predetermined number of times N (S27), to determine whether a substantial differential between consecutive sensings of the wet laundry amount persists. If so, an error condition is determined, whereby an accurate sensing of the laundry amount has failed, and an error message is displayed (S28).

As described above, in a washing machine control method according to the present invention, to prevent the setting of an incorrect water level when laundry is added to the washing machine after manipulating a wash command key, the water level and wash pattern are repeatedly reset according to a differential present in consecutively sensed wet laundry amounts, if a substantial differential is detected between dry and wet laundry amounts. That is, if the difference between consecutively sensed wet laundry amounts is reduced to a predetermined value, within a predetermined number of repeated sensings, the washing step is controlled according to reset values for the water level and wash pattern. Accordingly, the washing machine control method according to the present invention enables the accurate control of washing step, including water level and wash pattern, according to the amount of the laundry input before or after inputting a wash command key, thereby improving washing performance.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine control method comprising steps of:

detecting a first amount of laundry upon initiating a washing step;

determining a first water level based upon the first laundry amount;

supplying water to the washing machine up to the first water level after the first water level is determined;

detecting a second amount of laundry after water is supplied to the washing machine;

determining a first wash pattern based upon the second laundry amount;

calculating a first differential between the first and second laundry amounts; and comparing the calculated first differential to a first predetermined value;

when the first differential is greater than the first predetermined value, detecting a third amount of laundry;

calculating a second differential between the second and third laundry amounts; and comparing the calculated second differential to a second predetermined value;

when the second differential is not greater than the second predetermined value, determining a second water level and a second wash pattern based upon the third laundry amount and adjusting the first water level and the first wash pattern to the second water level and the second wash pattern.

2. The method as claimed in claim 1, wherein the detected first laundry amount is dry and the detected second and third laundry amounts are wet.

3. The method as claimed in claim 1, further comprising the step of:

performing the washing step according to the first water level and the first wash pattern, when the first differential is not greater than the first predetermined value.

4. The method as claimed in claim 1, further comprising the step of:

re-detecting the third laundry amount, when the second differential is greater than the second predetermined value.

5. The method as claimed in claim 4, further comprising the step of:

displaying an error message if said re-detecting is repeated a predetermined number of times.

6. The method as claimed in claim 1, further comprising the step of:

performing the washing step according to the second water level and the second wash pattern, when the second differential is not greater than the second predetermined value.

7. A method for controlling a washing machine, said method comprising:

detecting an amount of laundry in the washing machine a first time upon initiating a washing operation;

determining a first water level based upon the amount of laundry detected the first time;

supplying water to the washing machine up to the first water level after determining the first water level;

after water is supplied to the washing machine, detecting the amount of laundry a second time;

calculating a first differential between the amount of laundry detected the first time and the amount of laundry detected the second time; and comparing the first differential to a first predetermined value;

when the first differential is greater than the first predetermined value, detecting the amount of laundry a third time;

calculating a second differential between amount of laundry detected the second time and the amount of laundry detected the third time; and comparing the second differential to a second predetermined value;

when the second differential is not greater than the second predetermined value, determining a second water level based upon the amount of laundry detected the third time and adjusting the water level to the second water level.

8. The method according to claim 7, further comprising:

performing the washing operation using the first water level when the first differential is less than or equal to the first predetermined value.

9. The method as claimed in claim 7, further comprising the step of:

performing the washing operation using the second water level when the second differential is not greater than the second predetermined value.

* * * * *